US008256183B2

(12) United States Patent
Berlee et al.

(10) Patent No.: US 8,256,183 B2
(45) Date of Patent: Sep. 4, 2012

(54) SAFETY FEATURE FOR A ROOF

(75) Inventors: Anthonie Bernardus Berlee, Zeist (NL); Hans Antonius Borra, Zeist (NL)

(73) Assignee: Safeway GmbH, Engelberg (CH)

( * ) Notice: Subject to any disclaimer, the term of this patent is extended or adjusted under 35 U.S.C. 154(b) by 194 days.

(21) Appl. No.: 12/673,680

(22) PCT Filed: Aug. 15, 2008

(86) PCT No.: PCT/NL2008/050548

§ 371 (c)(1),
(2), (4) Date: Feb. 16, 2010

(87) PCT Pub. No.: WO2009/022910

PCT Pub. Date: Feb. 19, 2009

(65) Prior Publication Data

US 2011/0005150 A1 Jan. 13, 2011

(30) Foreign Application Priority Data

Aug. 15, 2007 (NL) ..... 2000814

(51) Int. Cl.
*E04B 1/38* (2006.01)

(52) U.S. Cl. ..... 52/698; 52/27; 248/237; 182/7; 182/113

(58) Field of Classification Search ..... 52/698, 52/745.21, 746.1, 749.12, 746.11, 273, 408, 52/410; 182/3, 5, 45, 231; 248/237
See application file for complete search history.

(56) References Cited

U.S. PATENT DOCUMENTS

| | | | | | |
|---|---|---|---|---|---|
| 4,249,713 | A | * | 2/1981 | Glynn et al. | 248/237 |
| 5,131,490 | A | * | 7/1992 | Bell | 182/7 |
| 5,168,684 | A | | 12/1992 | Bruhm | |
| 5,361,558 | A | * | 11/1994 | Thornton et al. | 52/698 |
| 5,431,372 | A | * | 7/1995 | Kostelecky | 256/64 |
| 5,623,788 | A | * | 4/1997 | Bimberg et al. | 52/23 |
| 5,730,407 | A | * | 3/1998 | Ostrobrod | 248/237 |
| 5,829,203 | A | * | 11/1998 | Ealer, Sr. | 52/37 |
| 5,896,719 | A | * | 4/1999 | Thornton | 52/698 |
| 6,003,282 | A | * | 12/1999 | Alderman et al. | 52/749.12 |

(Continued)

FOREIGN PATENT DOCUMENTS

DE 298 16 817 12/1998

(Continued)

OTHER PUBLICATIONS

International Search Report dated Nov. 10, 2008, from corresponding PCT application.

*Primary Examiner* — William Gilbert
*Assistant Examiner* — Beth Stephan
(74) *Attorney, Agent, or Firm* — Young & Thompson

(57) ABSTRACT

Safety structure for a roof and more particularly a flat roof. The former includes an engagement structure. The engagement structure provides an attachment element to which a part to be safely attached to the roof, such as the belt of individuals present on the roof, a railing or the like has to be attached. According to the present invention, this attachment element is attached to a thickening and more particularly to a profiled section. This thickening is accommodated in a folded-over part of roof covering material and is situated in the folded-over part thereof. This roof covering material is attached to the existing roof covering by torching or gluing.

18 Claims, 5 Drawing Sheets

U.S. PATENT DOCUMENTS

| | | | | |
|---|---|---|---|---|
| 6,418,685 | B1 * | 7/2002 | Oliver et al. | 52/293.3 |
| 6,648,381 | B2 * | 11/2003 | Holton et al. | 292/288 |
| 6,668,509 | B1 * | 12/2003 | Krebs | 52/698 |
| 7,178,306 | B2 * | 2/2007 | Fritz | 52/746.11 |
| 7,665,248 | B2 * | 2/2010 | Blackford | 52/27 |
| 2003/0093884 | A1 * | 5/2003 | Doty | 24/302 |
| 2005/0139419 | A1 * | 6/2005 | Green | 182/3 |
| 2005/0166468 | A1 * | 8/2005 | Pierce | 52/23 |
| 2006/0260260 | A1 * | 11/2006 | Blackford | 52/698 |
| 2006/0278472 | A1 * | 12/2006 | Kenton et al. | 182/113 |

FOREIGN PATENT DOCUMENTS

| | | |
|---|---|---|
| DE | 103 33 113 | 11/2004 |
| EP | 0 037 085 | 10/1981 |

* cited by examiner

SAFETY FEATURE FOR A ROOF

BACKGROUND OF THE INVENTION

The present invention relates to an engagement structure for a part which is to be attached to a roof of a building, said engagement structure comprising a fabric web to be applied to the roof and an attachment means extending there through for the part to be attached.

DESCRIPTION OF THE RELATED ART

Structures of this type are generally known in the prior art. By way of example, mention is made of a structure in which an attachment means which protrudes through a fabric web is attached to a plate-shaped part underneath the fabric web. This plate-shaped part may optionally be attached to the roof. If the plate-shaped part is attached to the roof, the original roof covering is pierced, which is undesirable. In the case of the structure where the plate-shaped part is not attached to the roof structure, the strength of the structure lies in the bonding force between the roof covering over the plate and the original roof covering.

However, it has been found that such structures, although possibly suitable for fitting railings and the like thereto, these structures do not meet the imposed safety requirements when a force which is directed parallel to the plane of the roof is applied. It has been found that in such cases, the plate to which the attachment means is attached and the attachment means itself, such as a pin, tilt and the roof covering which has been applied on top thereof is torn open or torn off the existing roof covering.

U.S. Pat. No. 5,168,684 discloses a stature for connecting a roof covering to a roof support. To that end overlapping roof webs are pressed onto each other through an elongated stick of material through which bolts extends received in the supporting structure below. There is no possibility to fix anything to such cover strip extending in outward direction.

DE 10333133 B3 shows an engagement structure which placed on the roof and on which a ballast is placed. This requires a stronger roof structure.

DE 29816817 U1 discloses a covering structure for a roof wherein between the roof cover and the roof a gridlike structure is provided extending beyond the roof covering and/or being provided with a connection eye. Also this structure could impair the liquid tightness of the roof structure.

SUMMARY OF THE INVENTION

There is therefore still a need for a safety feature and more particularly for an engagement structure to be attached to a roof, which satisfies the high demands which are imposed on safety structures which have to be provided on the roof temporarily and/or permanently. Such an attachment means has to be suitable for securing individuals who use belts when they work near the edge of the roof. In addition, it has to be suitable for carrying railing structures and the like in a safe manner. Furthermore the safety feature should be realised without ballasting.

In addition, it is an object of the present invention to provide an attachment structure which does not require the existing sealing covering to be pierced or affected in any other way in order to reduce the risk of leaks and/or other damage as much as possible.

The above described objects are achieved according to the present invention with the features discussed below.

According to the present invention, the thickening transforms the force applied from a point force to a linear force which is transmitted to the fabric web. By the transformation into a linear force, the force is distributed more evenly over the fabric web, thus preventing failure.

Attachment of the engagement structure to the roof is through adhesion. Adhesion can comprise a gluing, fusing, melting and so on. This provides a connection over a relatively large area. Penetration for example through nails, screws and the like is not used in subject invention to prevent damage to the sealing roof covering. Such sealing roof covering can be any material providing in watertightness of the roof structure or being a layer placed above such layer providing in watertightness. Outwardly extending of the attachment means, has to be understand as extending in a direction outwardly relative of the roof, i.e. in a building, in normal condition into the environment outside the building.

According to an advantageous embodiment of the present invention, the attachment means to which a belt, railing or the like can be attached is embodied to be combined with the thickening in such a manner that it can be tilted. If an individual or object falls off the roof, a force will be exerted on the attachment means which force is parallel to the covering (felt) of the roof. In contrast to the structures according to the present invention, this is not transformed into a lever movement which causes the roof covering or differently embodied fabric web to come off the roof, but the attachment means tilts with respect to the fabric web. The force which is exerted on the attachment means is then only a tensile force directed parallel to and directly above the existing roof covering. As a result thereof, the force exerted on the fabric web is substantially a shearing force and not partly an upwardly directed tensile force, as is the case in the prior art. As a result, a much higher degree of safety can be achieved using the same fabric web.

According to the present invention, the thickening and the engagement structure can be provided at various positions on the roof, but can also extend along the entire length of the roof. The thickening may include any conceivable embodiment, such as a cable, pin or the like.

However, according to an advantageous embodiment of the invention, the thickening is embodied as a profiled section. Such a profiled section may be a profiled section obtained by extrusion from any conceivable material, such as plastic or aluminium.

The attachment of the profiled section to the fabric web may be effected in any conceivable way. However, according to an advantageous embodiment of the invention, the fabric web is folded around the thickening. The folded-over part can be attached to the original part of the fabric web again. According to a further preferred embodiment the folded-over part does extend in a direction opposite to the direction of the original part i.e. is an extension thereof. This structure could be the base of a safety measure being effective in two directions. Such a safety measure could for example be used on relatively narrow roofs wherein a central (group of) safety measure(s) is (are) provided acting in two directions. Attachment of the folded-over part of the fabric web can be effected in a particularly simple manner if the fabric web also consists of roof covering material. Such a connection can be achieved in a simple manner by means of torching or another kind of bonding. More particular such roof covering material for the fabric web comprises a roof covering material having a web of a plastic material fabric which is provided (in the mounted condition) on the upper side of the web. Such material can have a colour being different from the colour of the remaining roof covering. If this material is for example white or has reflective properties the temperature of the layers below can be maintained at a lower level preventing decrease in adhesion strength between the fabric web and the existing roof covering at increased environmental temperatures if adhesives are used being temperature sensitive.

It is possible to carry out the work of folding-over either on the roof itself or to supply a ready-made engagement structure. In the latter case, certification is simpler and the conditions during the production of an engagement structure can be more readily controlled. Subsequently, according to the invention the engagement structure, more particularly the fabric web, can be attached to the existing roof covering in any way. If the fabric web comprises roof covering material, this may be effected by torching, but other ways of bonding are also possible. The present invention does not require the original roof covering to be pierced, so that there is no longer the risk of leakage.

According to a particular embodiment of the present invention, the thickening, and more particularly the thickening in the shape of a profiled section, is provided with an opening for accommodating a shaft which extends parallel to the end edge of the profiled section. The attachment means, such as a pin, may be fitted to such a shaft. The shaft is accommodated so as to be able to pivot or the pin is fitted to the shaft in such a manner that it is able to pivot. In both cases, the pin is able to carry out a tilting movement with respect to the profiled section in a simple manner.

In one particular embodiment, the preferred position of the pin or other attachment means is substantially vertical. In this position, the protruding pin or other attachment means is clearly visible and structures, such as railing structures, belts for people at work, cable systems for attaching these belts and the like, can be attached thereto. Only in the event of an accident, that is to say if the pin or other attachment means moves outside the periphery of the safety means, does the pin or other attachment means have to carry out the above-described tilting movement. In the above example of the profiled section provided with a pin and shaft, this is made possible by providing a slot in said profiled section along which the pin can pivot. Preferably, the slot and/or the fabric web folded around the latter is embodied to be slightly narrower than the thickness of the pin or other attachment means, so that a certain resistance has to be overcome before the abovementioned tilting movement can be performed.

It should be understood that the thickening can also be of a different embodiment. Thus, for example, it may be embodied as an elongate shaft which can tilt in the folded-over part of the fabric web material.

In a further embodiment of the invention distinction is made between the shaft around which the web material is (partially) folded and the tilting mechanism for the attachment means. For example it is possible to use an elongate thickening such as a tube around which the fabric material is folded. Immediately around the assembly of the thickening and the folded fabric material a slit like structure extends receiving a pin which can tilt in the related slit and execute a movement substantially around the thickening.

This embodiment has the advantage that it is simply possible to effect a tilting movement of the attachment in two directions relative to the thickening i.e. to provide a safety measure which is effective in two directions.

The invention also relates to a roof and more particularly to a flat roof provided with the above-described engagement structure. As has already been described, according to an advantageous embodiment, the engagement structure is prefabricated and can be fitted to the roof by torching. Welding, gluing and other ways of fastening are further variants. According to the present invention, the roof is provided with a number of the above-described engagement structures which are positioned at regular intervals. As an example of the positioning of an engagement structure, a distance of several to several tens of meters is mentioned. The dimensions of the engagement structure itself, for example, are 80×80 cm. This value relates to the dimensions over which the fabric web is attached to the original roof covering. It will be understood that these dimensions can vary within a wide range. It is also possible to provide a number of attachment means, in which case the associated fabric webs are embodied to be connected to one another. If desired, a common thickening may be provided in such a case.

The present invention also relates to a method for fitting a safety means to the roof which is provided with the above-described engagement structure. This attaching preferably takes place by fastening the fabric web to the original roof covering. This fastening can be achieved by means of torching, welding and the like.

It is possible to realize the invention in many conceivable variants. Thus, in one variant of the invention, it is possible to fit the attachment means externally to the thickening. That is to say that the thickening is situated in a turned-over part of fabric web and the attachment means are clamped around the latter. This clamping action can be improved further by providing attachment means with double action by enclosing a fabric web with thickening and clamping the fabric web with thickening by tightening the relevant parts of the attachment means against one another.

BRIEF DESCRIPTION OF THE DRAWING FIGURES

The present invention will be explained below with reference to exemplary embodiments illustrated in the drawing, in which:

FIG. 1 diagrammatically shows the top of a building with a part attached to the roof provided thereon;

DESCRIPTION OF THE PREFERRED EMBODIMENTS

Figure 1:
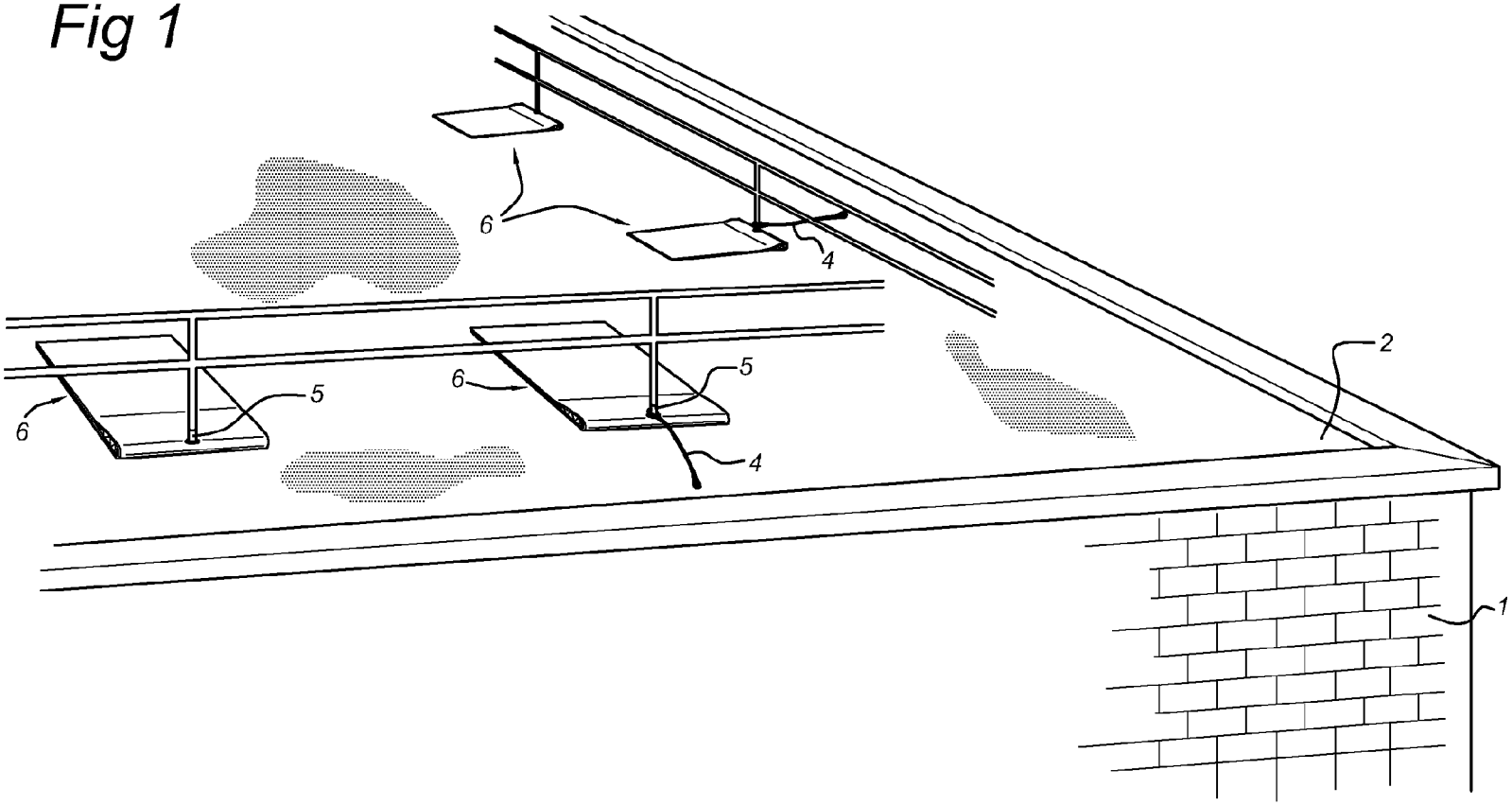

In FIG. 1, a building which is provided with a flat roof 2 is illustrated and denoted overall by reference numeral 1. It will be understood that the invention can also be used with slightly inclined roofs.

With all these roofs, it is a requirement that individuals who are near the edge of the roof take safety measures in order to prevent them from being injured if they fall from the roof.

To this end, the present invention proposes providing a number of engagement structures 6. The parts thereof which are particularly visible are the attachment means or pins 5, to which, for example, a railing structure or a belt 4 can be attached, as is illustrated highly diagrammatically in FIG. 1.

Such attachment means may comprise a snap connection, in which case the pin is provided with an eyelet, or a screw thread connection, click-fit connection or any other conceivable connection, for example a coupling or the like.

Figure 2:
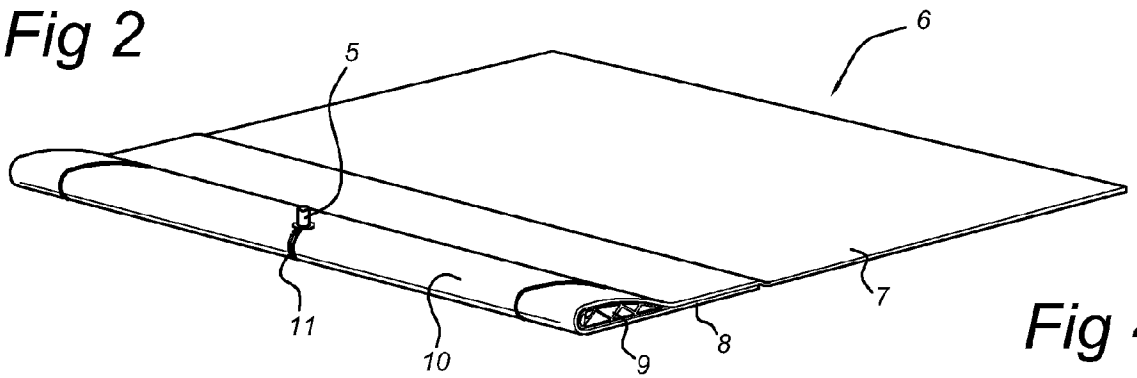
FIG. 2 shows a perspective view of the engagement structure according to the invention.
Figure 4:
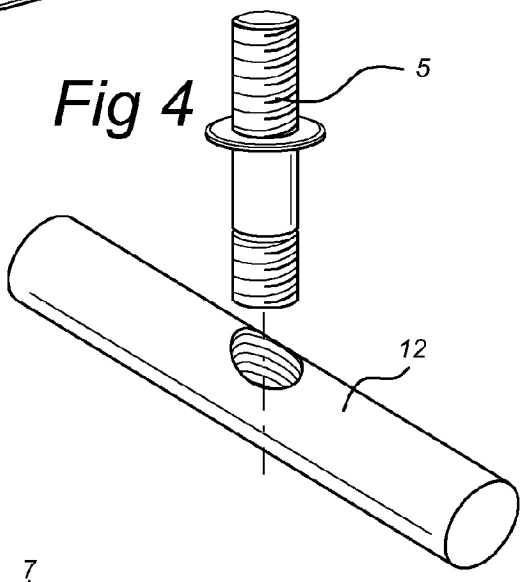
FIG. 4 shows how the pin 5 is attached to the associated shaft.
Figure 3:
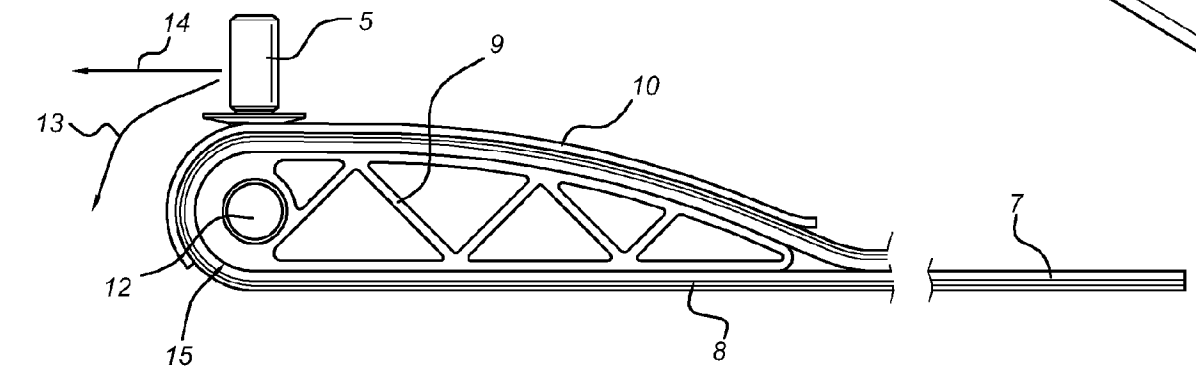
FIG. 3 shows a detailed cross-sectional view of the engagement structure according to the invention.

FIG. 2 illustrates the design of an engagement structure 6. It comprises a fabric web 7 having a dimension of, for example, 80×80 cm and is folded over near its end edge. The fabric web 7 may be a roof covering material. The folded-over part is denoted by reference numeral 8. The folded-over part 8 is fastened to the fabric web 7. If the fabric web 7 comprises a bituminous material, this may be effected by torching, but other ways of fastening, such as welding and gluing are also within the scope of the present invention. A thickening 9 in the form of a profiled section is provided inside the opening which has been created in this way. In the present case, said profiled section is an extruded profiled section, such as a plastic or aluminium profiled section. Details of said profiled section are illustrated in FIG. 3. Midway along the longitudinal extension of the fabric web 7, the pin or attachment means 5 is provided. As is illustrated in FIG. 3 and FIG. 4, this pin 5 is screwed into a shaft 12 and the shaft 12 is accommodated in the profiled section 9. Shaft 12 can pivot inside profiled section 9. As can be seen in FIG. 2, the folded-over part 8 is provided with a groove 11 and a corresponding groove is provided in the profiled section 9, so that pin 5 can tilt in the direction of arrow 13 in FIG. 3. If desired, a cover 10 may be provided near the profiled section 9 on the fabric web 7 in order to protect the material. It is also possible to omit said cover.

The engagement structure 3 is preferably prefabricated and delivered to the building site. The fabric web 7 is preferably such that it can be attached to the existing roof covering in a simple manner, for example by torching. As a result thereof, the engagement structure 6 and the existing roof covering are bonded over a large surface area and it is not necessary to provide structures which run through the existing roof covering.

The engagement structure shown in FIGS. 2 and 3 is fitted in such a manner that the profiled section 9 is closest to the roof edge.

If, for example, a belt 4 is attached to pin 5 and the respective individual or an object falls from the roof, the latter will be subjected to a force in the direction of arrow 14. However, due to the fact that the pin 5 can pivot with respect to profiled section 9, this force will not result in a tilting moment of profiled section 9, but pin 5 will tilt in the direction of arrow 13. As a result, a negligible upwardly directed tensile force is exerted on the fabric web 7 at a location 8 near the pin and profile section and the load only consists of a shearing force on the existing roof covering.

If the fabric web 7 in particular has been attached to the existing roof covering in the correct manner (in a certified manner), the load it is to absorb is so high that there is no danger of failure. As a result, forces of several tons can be exerted on the pin 5, which forces are transmitted to the existing roof structure via the profiled section 9 which gradually transfers these forces to the fabric web 7 through the rounding at its front which is denoted by 15.

Starting from existing material and in particular existing roof covering materials which are provided with fabric, it is possible to absorb very large forces using the present invention. Parts such as the extrusion profile 9 and attachment means or pin 5 can be produced in a simple manner so that they are also very strong.

Therefore, it is possible to produce a safety structure which amply meets the requirements to be imposed using relatively simple means.

Figure 5:
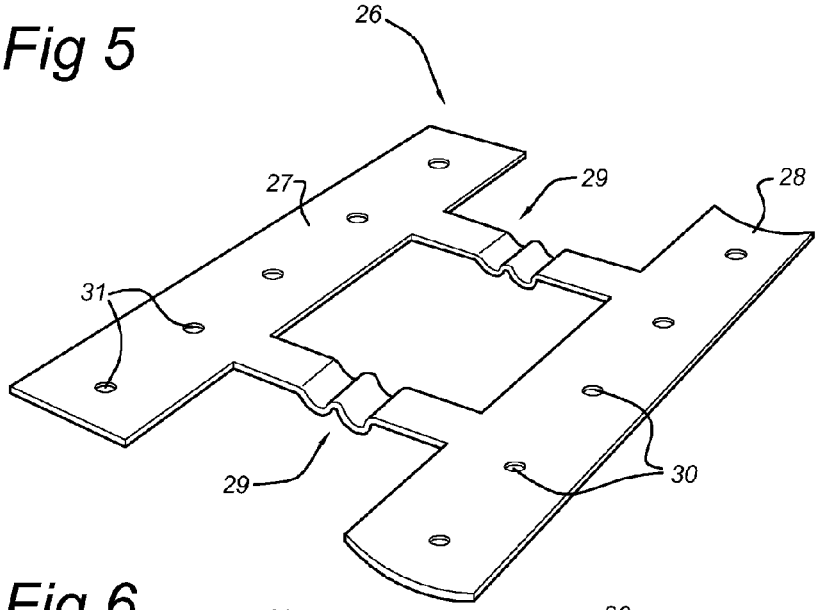
FIGS. 5-7 show a variant of the structure described with reference to FIGS. 1-4.
Figure 6:
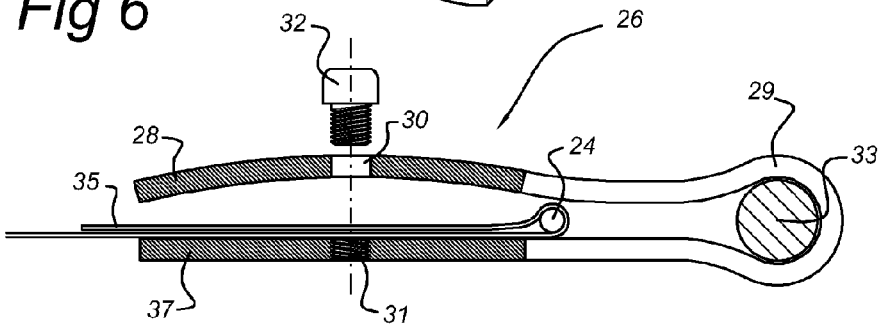
Figure 7:
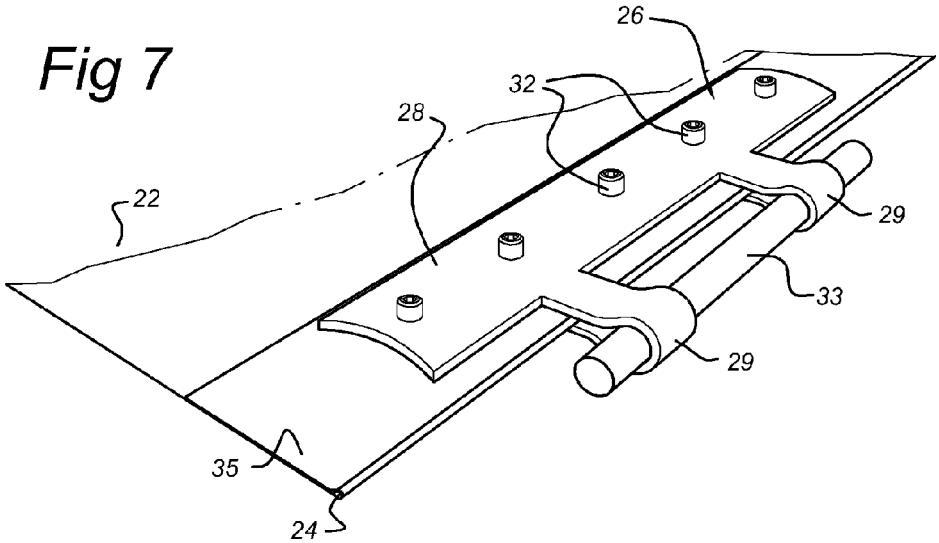

FIGS. 5-7 show a variant of the invention. A fabric web is denoted by reference numeral 22 and provided with a folded-over part 35. The fold comprises a thickening 24. In this embodiment, the attachment means is denoted overall by reference numeral 26 and comprises two plates 27 and 28 which can pivot with respect to one another and are provided with apertures 31 and 30, respectively. Cavities are provided near the pivot connection 29 for accommodating a pin 33. FIG. 5 illustrates the attachment means 26 in folded-open position, while FIGS. 6 and 7 illustrate an attachment means on the fabric web 22. By folding the parts 27 and 28 together and moving them towards one another in a pivoting manner when the folded-over part of the fabric web and thickening 24 are accommodated, the latter are clamped in. When correctly positioning the parts 27 and 28 with respect to one another, a securing bolt 32 can be introduced through aperture 30 and secured in the screw thread 31, resulting in a tight clamping action. Safety structures, such as belts, railings and the like are fastened to pin 33. This pin 33 is at a very low level and acts as a pivot pin so that any forces acting thereon are transmitted to the thickening 4 via the attachment means 6 without tilting moment which in turn ensures that a point load is transformed into a linear load in the fabric web, thus making it possible for this fabric web to withstand great loads.

Figure 8:
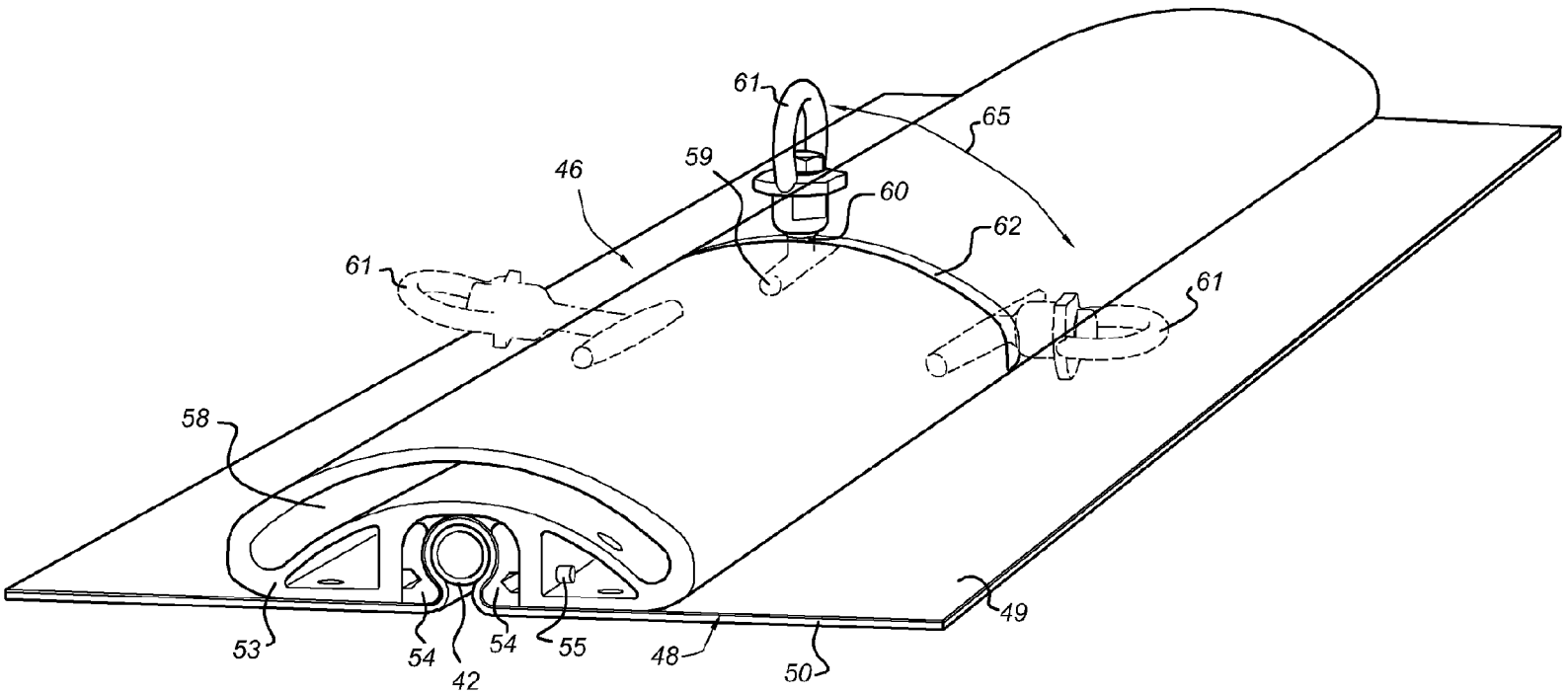
FIG. 8 shows a alternative embodiment of the invention and FIG. 9 the application of the embodiment of FIG. 8.
Figure 9:
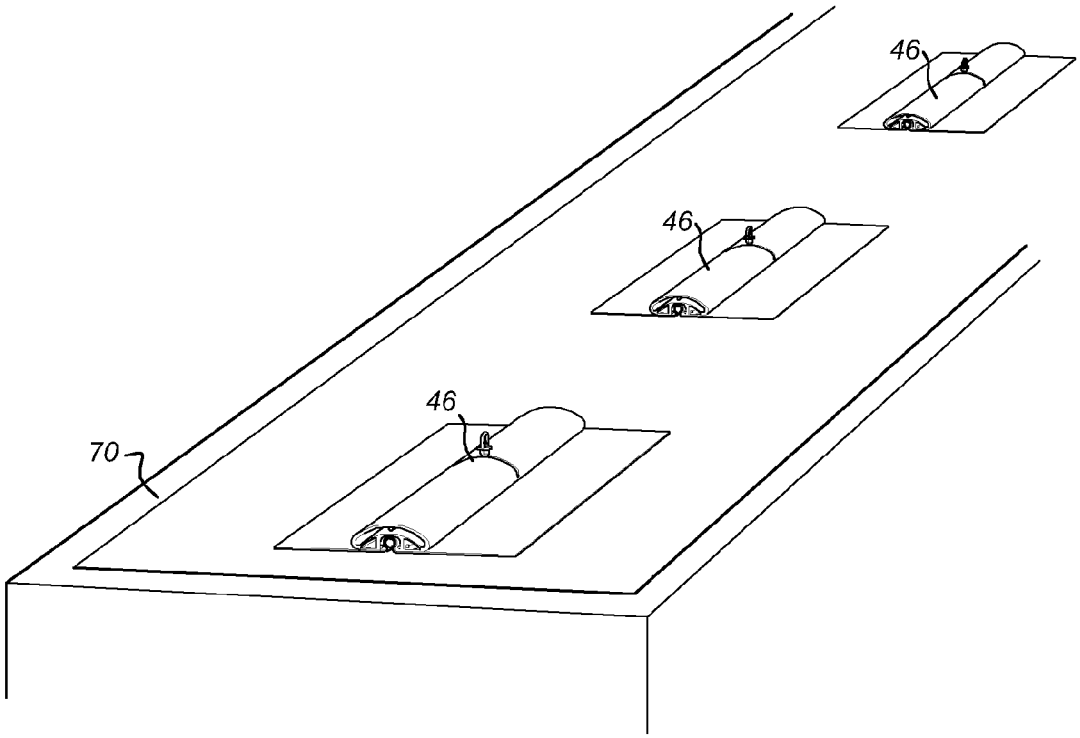

In FIGS. 8 and 9 a further embodiment of the invention is shown.

In FIG. 8 the engagement structure is generally referred to by 46. This comprises a thickening or tube 42 and a fabric web 48 is folded over this thickening or tube 42. Fabric web 48 comprises a top layer 49 being a light reflecting layer and a bituminous lower layer 50. For example through torching lower layer 50 can be adhered to the existing roof covering whilst reflective layer 49 prevents heat adsorption.

As is shown in FIG. 8 folding over of web 48 is only partially because web 48 extends after the thickening 42 in the opposite direction.

An extruded profile 53 is present wherein clamping shoes 54 can be slit and through screws 55 clamping shoes 54 can be pushed inwardly to clamp web 48 on tube 42. Of course any other clamping mechanism can be used to position the tube 42 relative to the clamping shoes or more general profile 53. Profile 53 is preferably an extruded profile and is provided with an semi-circular slit 58. This slit 58 is receiving a shaft 59 wherein a pin 60 can be screwed on which an eye 61 for connection to a safety harness or the like is provided. A central elongated opening 62 is provided in profile 53 such that eye 61 can move between the two dotted positions in the direction of arrow 65. In the lowest position eye 61 is substantially in the horizontal extension of tube 42. I.e. if in this position a traction force parallel to the roof surface is exerted there will be no upward momentum trying to pull away web 48 from the roof covering being below. This considerably contributes to the high strength which can be obtained with the device according to subject application.

FIG. 9 schematically shows a building 70 on which a number of engagement structures are provided acting in two directions i.e. can be used both for activities on the left hand and the right hand side of the building as seen in FIG. 9.

Upon reading the above, those skilled in the art will immediately be able to think of variants which are within the scope of the invention.

The invention claimed is:

1. A roof provided with an engagement sealing structure, for a part which is to be attached to a roof of a building, said roof comprising a sealing roof covering, said engagement structure comprising i) a fabric web adhered to the sealing roof covering without penetration therethrough, ii) an attachment means extending outwardly through said fabric web, the attachment means for attaching a safety measure to said engagement structure, and iii) a linear extending thickening provided near one end of said fabric web, wherein said attachment means is attached to said thickening.

2. Roof according to claim 1, wherein said attachment means and thickening are embodied such that said attachment means can be tilted with respect to said fabric web.

3. Roof according to claim 2, wherein said thickening comprises an elongate profiled section.

4. Roof according to claim 1, wherein said thickening is accommodated in a folded-over peripheral part of said fabric web.

5. Roof according to claim 4, wherein the folded-over part is attached to a non-folded-over part of said fabric web when said thickening is accommodated therein.

6. Roof according to claim 1, wherein the attachment means can be tilted over about 180°.

7. Roof according to claim 6, wherein said thickening is accommodated in a folded-over peripheral part of said fabric web, and after folding over the fabric web extends in the original direction.

8. Roof according to claim 1, wherein the thickening together with the fabric web is clampingly received in a housing, said housing comprising a semi-circular guide system to which the attachment is connected.

9. Roof according to claim 1, wherein said fabric web is impregnated with a fusing/adhesive material.

10. Roof according to claim 9, wherein said fusing/adhesive material comprises a bituminous material.

11. Roof according to claim 1, wherein said attachment means comprises a shaft which pivots with respect to said thickening.

12. Roof according to claim 1, wherein said shaft is pivotable between a vertical position of use and a horizontal safety position.

13. Roof according to claim 1, wherein a part is provided which counteracts the tilting movement of said attachment means with respect to said thickening and which is effective up to a threshold value.

14. Roof according to claim 1, wherein a guard plate is provided on said fabric web at the location of said thickening.

15. Roof according to claim 1, comprising a flat roof, wherein said fabric web is attached to said flat roof.

16. Roof according to claim 1, comprising a series of engagement structures, provided at a distance from one another along the periphery of said roof.

17. A method for fitting a safety means to a roof comprised of an existing sealing roof covering, comprising the steps of:

providing an engagement structure for a part which is to be attached to a roof of a building, said engagement structure comprising a fabric web to be adhered to the existing sealing roof covering without penetration therethrough, and providing an attachment means extending outwardly through said fabric web, the attachment means for attaching a safety measure to said engagement structure, said engagement structure comprising a linear extending thickening provided near one end of said fabric web, wherein said attachment means is attached to said thickening; and fastening said fabric web to the existing sealing roof covering, by gluing, fusing or melting without penetration through said existing sealing roof covering followed by fitting a safety means to said attachment means.

18. Method according to claim 17, wherein said fastening comprises torching.

* * * * *